US006352327B1

(12) United States Patent
Yano et al.

(10) Patent No.: US 6,352,327 B1
(45) Date of Patent: Mar. 5, 2002

(54) PRINTING APPARATUS AND PRINT CONTROL METHOD

(75) Inventors: Kentaro Yano; Naoji Ohtsuka, both of Yokohama; Kiichiro Takahashi, Kawasaki; Hitoshi Nishikori, Inagi; Osamu Iwasaki, Tokyo; Daigoro Kanematsu, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/191,531

(22) Filed: Nov. 13, 1998

(30) Foreign Application Priority Data

Nov. 14, 1997 (JP) ..... 9-314089
Nov. 9, 1998 (JP) ..... 10-318005

(51) Int. Cl.[7] ..... B41J 29/38
(52) U.S. Cl. ..... 347/14
(58) Field of Search ..... 347/14, 17, 19, 347/43, 23, 33

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,033,887 A | | 7/1991 | Bauerle | 400/175 |
| 5,606,355 A | * | 2/1997 | Komatsu | 347/14 |
| 5,627,572 A | | 5/1997 | Harrington, III et al. | 347/23 |
| 6,062,667 A | * | 5/2000 | Matsui et al. | 347/17 |
| 6,126,266 A | * | 10/2000 | Numata et al. | 347/19 |
| 6,164,756 A | * | 12/2000 | Takahashi et al. | 347/43 |

FOREIGN PATENT DOCUMENTS

| | | |
|---|---|---|
| EP | 0 274 435 | 7/1988 |
| EP | 0 633 136 | 1/1995 |
| EP | 0 692 769 | 1/1996 |
| EP | 0 767 067 | 4/1997 |
| JP | 54-056847 | 5/1979 |
| JP | 59-123670 | 7/1984 |
| JP | 59-138461 | 8/1984 |
| JP | 60-071260 | 4/1985 |

* cited by examiner

*Primary Examiner*—N. Le
*Assistant Examiner*—K. Feggins
(74) *Attorney, Agent, or Firm*—Fitzpatrick, Cella, Harper & Scinto

(57) ABSTRACT

A printing apparatus and print control method, capable of using plural types of printheads, can achieve high throughput by performing optimized print control in accordance with the type of printhead and the number of printheads used. In a case where the printing apparatus adopting such print control method includes, e.g., four printheads, and performs printing on a print medium by reciprocally scanning the printheads, detection is first performed as to whether only one printhead which discharges black ink is mounted or four printheads which respectively discharge black, yellow, cyan and magenta ink are mounted; decision is made on a printing period of the printhead based on the detected result; then decision is made on a scanning speed of the printhead based on the decided printing period; and the printhead is driven based on the decided printing period and scanning speed to perform printing.

19 Claims, 9 Drawing Sheets

FIG. 4

| TYPE OF HEAD / SIGNAL LINE | Y HEAD | M HEAD | C HEAD | Bk HEAD |
|---|---|---|---|---|
| ID0 | OPEN | CLOSED | OPEN | CLOSED |
| ID1 | OPEN | OPEN | CLOSED | CLOSED |
| ID2 | CLOSED | ← | ← | ← |

PRINTING APPARATUS AND PRINT CONTROL METHOD

BACKGROUND OF THE INVENTION

The present invention relates to a printing apparatus and print control method and, more particularly, to a printing apparatus capable of performing printing in accordance with an ink-jet printing method, and print control method thereof.

Recently, as office automation devices such as personal computers, word processors or the like, are widely used, various printing methods and printing apparatuses are developed for printing data inputted by these apparatuses. Particularly, the printing apparatus adopting the ink-jet printing method is advantageous because the apparatus can perform full-color image printing despite its small size and inexpensive price, thus becoming rapidly popular.

In the ink-jet printing method, since ink droplets are discharged to a print medium to perform printing, the printing apparatus comprises means for recovering reliability of discharging ink droplets. Examples of recovery are: suction recovery in which ink is compulsorily suctioned from the printhead and drawn off as necessary; preliminary discharge recovery in which ink is periodically discharged to a predetermined position; a wiping operation in which the surface of the printhead where ink discharge nozzles are formed is wiped by a blade made of rubber or the like to remove ink on the surface; and so forth. Furthermore, by integrating a printhead and an ink tank into a cartridge of a maintenance-free disposable type, the operability and applicability for users are improved.

Meanwhile, as an attempt to improve the quality of printed images, a simplified color printing apparatus has been developed, taking advantage of the exchangeability of disposable printheads. In the simplified color printing apparatus, a monochrome printing apparatus can easily become a color printing apparatus by a user exchanging the printhead for monochrome printing with the printhead for color printing. Furthermore, various types of high-quality printing apparatuses have been developed, taking advantage of the exchangeability of disposable heads, as exemplified by a color printing apparatus capable of simultaneously printing images in plural colors by having a plurality of printheads, or an apparatus incorporating a plurality of printheads for printing at different densities of the same color by simultaneously using plural inks having the same color (tone) but different densities.

In addition, higher printing speed is also a vital technical issue, along with higher quality. To achieve this, the number of ink discharge nozzles in a printhead is increased (multi-nozzle printhead), having been supported by developments in semiconductor manufacturing technology. Although increasing the number of nozzles results in increase in the power supply in the apparatus, by virtue of adopting the time-divisional block driving method where nozzles are segmented into blocks and printing elements are driven block by block instead of simultaneously driving the entire printing elements to discharge ink from all the nozzles, it is possible to minimize the electric power consumed at once.

Taking into account that different densities of ink are used for gradation printing or a plurality of printheads, each using a particular color ink, are used for color printing, the controller which performs driving control and printing control using a printhead, and recovery mechanism of the printhead must be able to cope with any situations that may occur.

In a case of a printhead which discharges black ink for monochrome printing, color ink for color printing, or dark-colored ink and light-colored ink of the same color, all the ink is not always discharged under the same conditions. There are inks and printheads which require a large amount of energy, whereas there are inks and printheads which require a small amount of energy.

In order to simply realize high-speed printing by using a printhead, a larger amount of energy per unit time may be supplied. However, taking the diversity of printheads into account, a conventional printing apparatus limits its printing speed to a certain speed based on the assumption that the printhead which consumes the maximum electric power suppliable is driven, because the power capacity of the printing apparatus is limited. Therefore, even if a printhead consuming a small amount of electric power is used, there is a case where high-speed printing cannot be attained although such printhead has the potential to perform high-speed printing with a larger amount of energy per unit time.

Furthermore, in the conventional printing apparatus, the timing of recovery control for a printhead is predetermined based on the standard timing of a printhead having the least discharge reliability. Therefore, even if a printhead having high discharge reliability is used, recovery operation is automatically performed even when the recovery control is unnecessary. By performing recovery operation more than necessary, a problem of reduced printing speed occurs despite the fact that higher throughput is possible if the recovery operation is not performed.

SUMMARY OF THE INVENTION

The present invention is made in consideration of the above situation, and has as its object to provide a printing apparatus and print control method for achieving high throughput by performing optimized print control in accordance with the type and the number of printheads used, in a case where plural types of printheads are used.

The printing speed of a printing apparatus depends upon various aspects, e.g., the time required for driving printing elements, the capacity of the power source of the printing apparatus, the time necessary for ink refill which largely attributes to the printing speed in the ink-jet printing apparatus and so on. According to the present invention, each of the above aspects which affects the printing speed is considered in accordance with the type and the number of printheads mounted to the printing apparatus, and the driving period of the printhead as well as conditions related to various print controls are optimized so as to achieve printing at high speed.

According to one aspect of the present invention, the foregoing object is attained by providing a printing apparatus for performing printing on a print medium by mounting a printhead having a plurality of print elements and using the printhead, comprising: a mounting portion in which at least one printhead can be mounted; scanning means for reciprocally scanning the printhead; detecting means for detecting a type of printhead and a number of printheads mounted; first deciding means for deciding a driving condition of the printhead based on a result of detection by the detecting means; second deciding means for deciding scanning speed of the scanning means based on the driving condition decided by the first deciding means; and control means for executing printing by driving the printhead based on the driving condition decided by the first deciding means, and performing print operation by driving the scanning means based on the scanning speed decided by the second deciding means.

Herein, the printhead may be an ink-jet printhead which performs printing by discharging ink. In this case, it is preferable that the printhead comprises an electrothermal transducer for generating heat energy in order to discharge ink by utilizing the heat energy.

Furthermore, it is preferable that the printing apparatus comprises recovery means for performing recovery operation on the printhead; and recovery control means for setting a recovery condition of the recovery means based on the result of detection by the detecting means and executing the recovery means in accordance with the set recovery condition. The aforementioned recovery condition includes a time interval for performing preliminary discharge, a wiping interval for wiping an ink discharge surface of the printhead, and a time interval for performing suction recovery.

The printhead mentioned above includes a first head for discharging black ink; a second head for discharging yellow ink; a third head for discharging magenta ink; and a fourth head for discharging cyan ink.

In this case, it is detected whether only the first head is mounted, or the first, second, third and fourth heads are mounted, and a printing period for discharging ink from the printhead is decided by the first deciding means, based on the result of detection.

Alternatively, it is detected whether or not a plurality of the first, second, third or fourth heads are mounted, and the second deciding means decides the scanning speed of the scanning means according to the result of detection.

Furthermore, a carriage on which the four printheads are mounted, is provided to the scanning means. The carriage comprises four groups of first connection terminals connected to the printhead for identifying the type of printhead mounted, and the printhead comprises second connection terminals to be connected to the first connection terminals. The detecting means detects the type and the number of printheads based on a connection state between the first and second connection terminals. In this case, the first and second connection terminals respectively comprise three connection terminals, and the detecting means detects existence of a printhead mounted based on a connection state of one of the three connection terminals and detects the type of printhead based on a connection state of the remaining two connection terminals.

According to another preferred embodiment, in a case where a carriage, on which the four printheads are mounted, is provided for the scanning means, the carriage comprises four first connection terminals connected to the printhead for identifying a type of printhead mounted, and the printhead comprises a second connection terminal to be connected to one of the first connection terminals and a ROM storing information indicating the type of the printhead, the detecting means can detect a type of printhead and a number of printheads based on the information from the ROM inputted by a connection between the first and second connection terminals.

According to still another preferred embodiment, in a case where a carriage, on which the four printheads are mounted, is provided for the scanning means, the carriage comprises four first connection terminals connected to the printhead for identifying a type of printhead mounted, and the printhead comprises a second connection terminal to be connected to one of the first connection terminals and a resistor, whose value indicates the type of the printhead, connected to the second connection terminal in series, the detecting means can detect a type of printhead and a number of printheads based on a voltage drop caused by the resistor by a connection between the first and second connection terminals.

According to another aspect of the present invention, the foregoing object is attained by providing a print control method using at least one printhead for performing printing on a print medium by reciprocally scanning the printhead, comprising: a detecting step of detecting the type and the number of printheads mounted; a first deciding step of deciding a driving condition of the printhead based on a result of detection in the detecting step; a second deciding step of deciding scanning speed of the printhead based on the driving condition decided in the first deciding step; and a control step of executing printing by driving the printhead based on the driving condition and scanning speed decided in the first and second deciding steps.

Herein, in a case where the printhead is an ink-jet printhead which performs printing by discharging ink, a recovery condition for a recovery step, in which recovery operation is performed on the printhead, is set, and the recovery step is executed in accordance with the set recovery condition.

According to still another aspect of the present invention, the foregoing object is attained by providing a printing apparatus for performing printing on a print medium by mounting a printhead having a plurality of print elements and using the printhead, comprising: a mounting portion in which a plurality of printheads can be mounted; detecting means for detecting a type of printhead and a number of printheads mounted in the mounting portion; divisional drive means for dividing the plurality of print elements in a printhead into a plurality of blocks, and sequentially driving each of the plurality of blocks; and control means for changing a number of the plurality of blocks based on a result of detection by the detecting means, and performing printing.

Note that it is preferable that the printhead is an ink-jet printhead, which performs printing by discharging ink, comprising an electrothermal transducer for generating heat energy in order to discharge ink by utilizing the heat energy.

According to still another aspect of the present invention, the foregoing object is attained by providing a print control method for performing printing on a print medium by mounting a printhead having a plurality of print elements and using the printhead, comprising: a detecting step of detecting a type of printhead and a number of printheads mounted in a mounting portion in which a plurality of printheads can be mounted; a deciding step of deciding a division number by which the plurality of print elements are divided, based on a result of detection in the detecting step; and a driving step of dividing the plurality of print elements into a plurality of blocks by the division number decided at the deciding step, and sequentially driving each of the plurality of blocks.

In accordance with the present invention as described above, in a case where the printing apparatus, comprising at least one printhead, performs printing on a print medium by reciprocally scanning the printhead, the type and the number of the printheads mounted are detected, and based on the detected result, driving conditions of the printhead are decided. Based on the decided driving conditions, scanning speed of the printhead is decided, and based on the decided driving conditions and scanning speed, printing is performed.

The present invention is particularly advantageous since it is possible to perform printing such that the printhead mounted is used to its full capability.

By virtue of this, a high-quality image can be outputted at highest speed and unnecessary recovery processing is eliminated, thus improving the total throughput of the printing apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 4 is a table showing open/closed relations between the type printhead and signal lines ID0, ID1 and ID2;

DETAILED DESCRIPTION OF THE PREFERRED EMBODIMENTS

Preferred embodiments of the present invention will be described in detail in accordance with the accompanying drawings.

Figure 1:
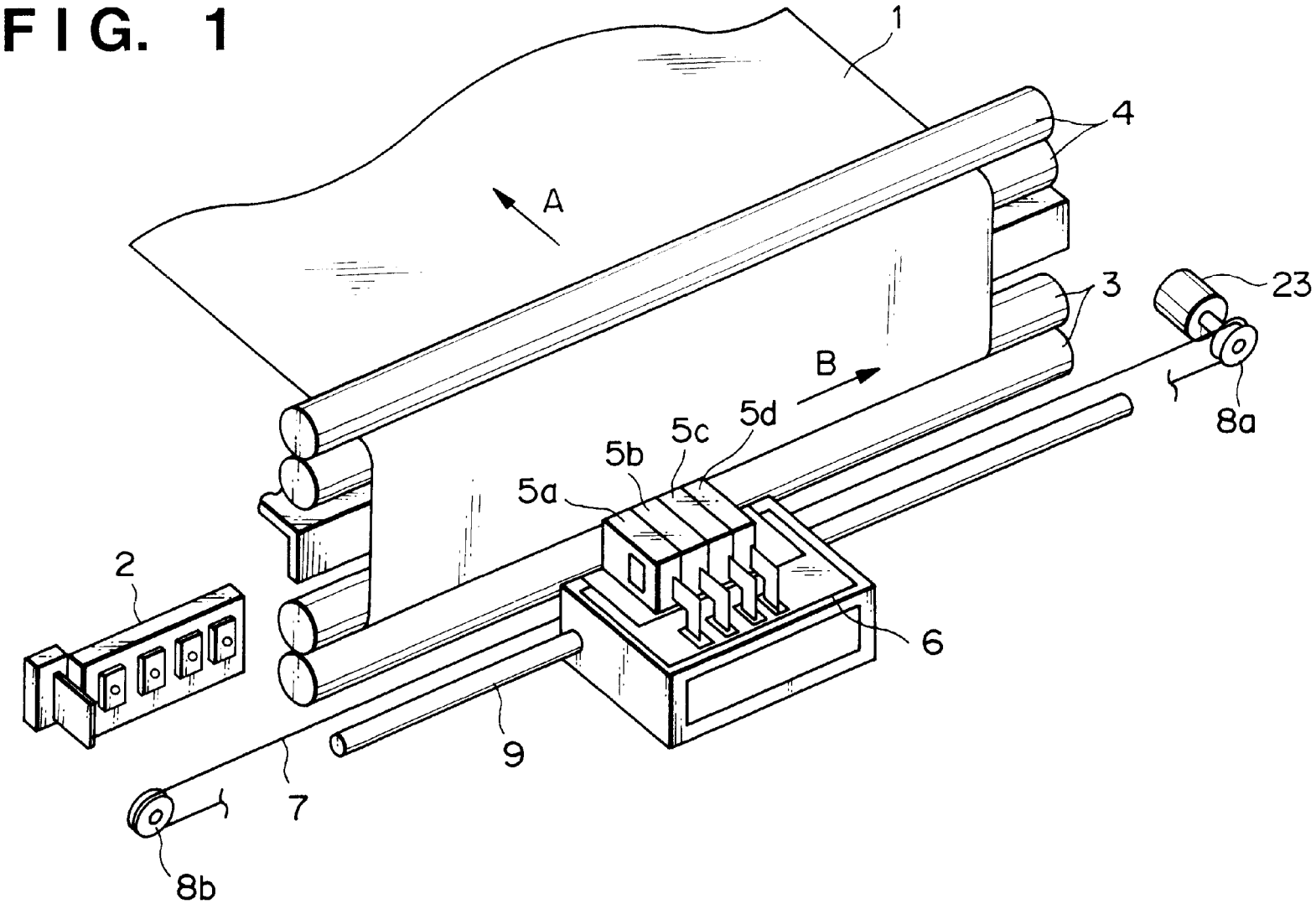
FIG. 1 is a perspective view of a printing apparatus, as a typical embodiment of the present invention, which performs printing by using a printhead according to an ink-jet printing method.

FIG. 1 is a perspective view of a printing apparatus as a typical embodiment of the present invention, which performs printing by using a printhead according to an ink-jet printing method. The printing apparatus realizes printing by using a plurality of printheads. The plurality of printheads are exchangeable, and capable of color printing if a plurality of color inks are supplied to these plurality of printheads, or capable of printing in high tonality representation if a plurality of inks having the same color but different densities are supplied to the plurality of printheads.

Next, the operation and construction of the printing apparatus are described.

When a print medium 1, e.g., a sheet of paper, a plastic sheet or the like, is supplied by a paper feed roller (not shown) sheet by sheet from a cassette (not shown) where a plurality of sheets of paper or plastic sheets are stacked, the print medium 1 is conveyed in the direction indicated by arrow A by a pair of conveyance rollers 3 and a pair of conveyance rollers 4, provided with a predetermined space, which are driven by respective stepping motors (not shown).

Printheads 5*a* to 5*d* (hereinafter these printheads are referred to as printhead 5) are mounted on a carriage 6. A carriage motor 23 is connected to the carriage 6 via a belt 7 and pulleys 8*a* and 8*b*. The printhead 5 reciprocally scans along a guide shaft 9 as the carriage motor 23 is driven. Ink is supplied to the printhead 5 from an ink cartridge (not shown), and in accordance with inputted image signals, ink is discharged to the print medium 1 from ink discharge nozzles, thus performing printing.

With the foregoing configuration, the printhead 5 discharges ink to the print medium 1 in accordance with inputted image signals while moving in the direction indicated by arrow B, and prints an image corresponding to a single scan. Then, while the printhead 5 is returning to the home position, the print medium 1 is conveyed to the direction of arrow A for a width corresponding to the single scan of printing. The printhead 5 which returns to the home position performs printing for the next single scan while moving in the direction of arrow B. By repeating the foregoing steps, an image is printed on the print medium 1.

During the printing operation, the printhead 5 returns to the home position as necessary, for suction recovery performed by an ink recovery unit 2 to maintain and recover discharge reliability. In the suction recovery operation, in order to maintain and recover the discharge reliability, the printhead 5 executes preliminary discharge to a cap provided in the ink recovery unit 2.

Figure 2:
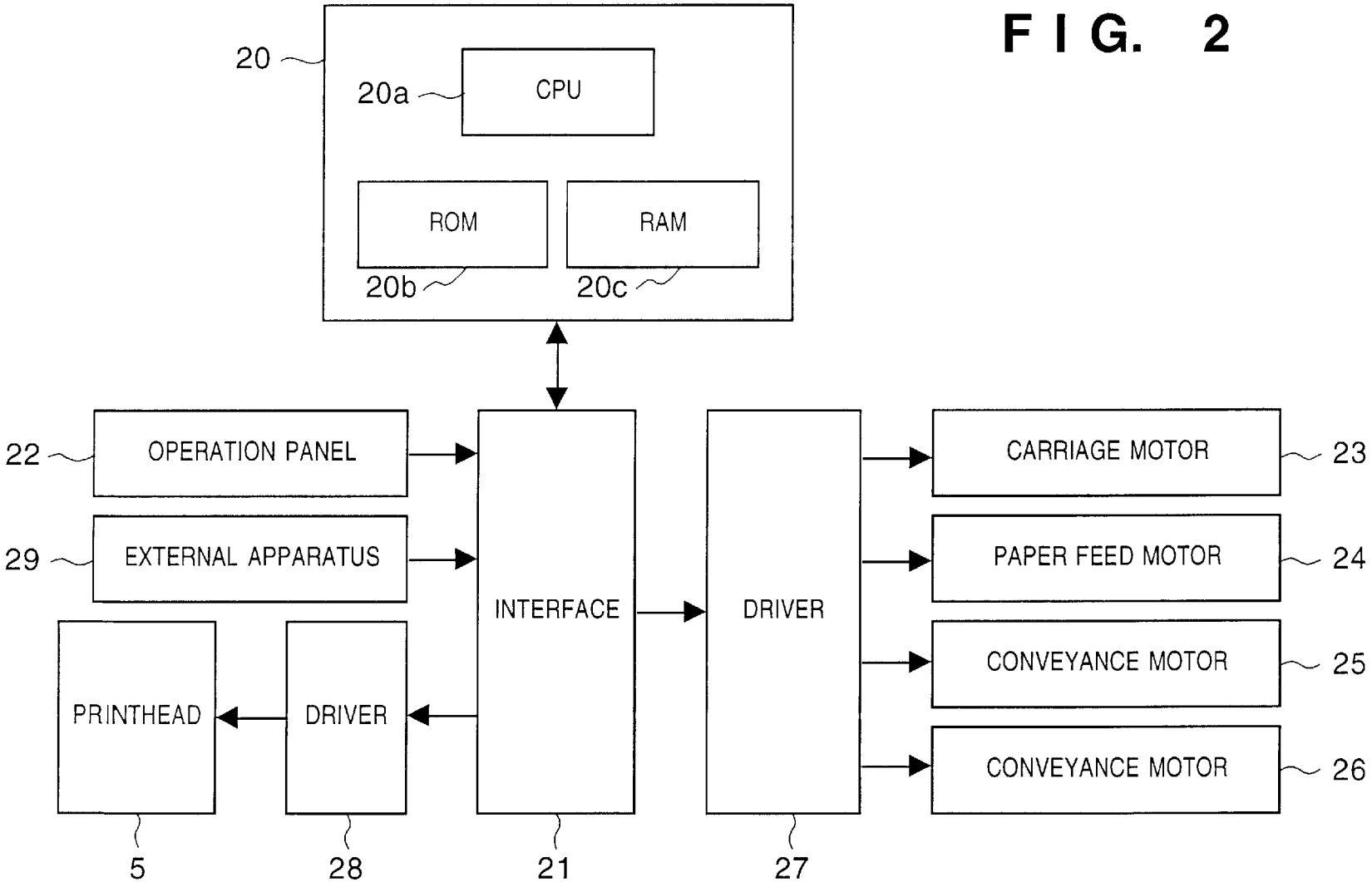
FIG. 2 is a block diagram showing a control unit of the printing apparatus shown in FIG. 1.

FIG. 2 is a block diagram showing a control unit of the printing apparatus shown in FIG. 1.

As shown in FIG. 2, the control unit comprises: a controller 20 including e.g. a CPU 20*a* in the form of microprocessor, ROM 20*b* where control programs executed by the CPU 20*a* and various data are stored, and RAM 20*c* used as a work area when the CPU 20*a* executes the control programs and where various data such as image data or the like are temporarily stored; an interface unit 21 serving as an intermediary for data transmission/reception between the controller 20 and each unit of the apparatus; an operation panel 22; a carriage motor 23 which drives the carriage 6; a paper feed motor 24 which drives the paper feed roller used when feeding the print medium 1 from the cassette; a conveyance motor 25 which drives the pair of conveyance rollers 3; a conveyance motor 26 which drives the pair of conveyance rollers 4; a driver 27 for driving these motors; and a head driver 28 which drives the printhead 5.

The controller 20 inputs/outputs various data (e.g., character pitch, character type, type of printhead 5 and so on) inputted by a user from the operation panel 22 through the interface unit 21, or image signals transferred by an external apparatus 29 such as a host unit. Moreover, the controller 20 generates ON/OFF signals for driving each of the motors 23 to 26 through the interface unit 21, and outputs image signals to the head driver 28 to control print operation.

The printing apparatus is capable of holding up to four printheads (5*a* to 5*d*) as shown in FIG. 1. In a case of performing color printing by these printheads, the printheads 5*a* to 5*d* respectively discharge color ink Bk (black), C (cyan), M (magenta) and Y (yellow). Herein, the printheads 5*a* to 5*d* are respectively referred to as Bk head, C head, M head and Y head for descriptive convenience in order to specify the type of printhead. Each of the printheads has 64 ink-discharge nozzles which are arranged such that printing at 360 dpi (dot per inch) is realized. In actual printing, the controller 20 controls printing such that 64 nozzles of each printhead are divided into four blocks (16 nozzles/block) and printing elements (heating elements) provided to respective nozzles in the same block are simultaneously driven.

The amount of black ink discharged by the Bk head is about 80 ng/dot, while the amount of color ink discharged respectively by the C head, M head and Y head is about 40 ng/dot. In the present embodiment, highly penetrative ink is used for color ink in order to prevent blurring, and not penetration-oriented but color-oriented ink is used for black ink. Although black ink and color ink have a difference in the amount of ink discharged per dot, when the ink is discharged to a print medium, the dot diameter formed with ink discharged on the print medium is about the same. Furthermore, refill time (from the time an ink droplet is discharged till the time the nozzle is refilled with ink and ready to discharge the next ink droplet) is about 100 μs for both black ink and color ink.

When each printhead is driven by the power voltage of 24 V, a current of 220 mA per nozzle is sent to the heating elements of Bk head and 150 mA per nozzle is sent to the heating elements of color (C, M and Y) heads. The current sending time (driving pulsewidth), required to discharge ink by sending the current pulse, is 3 μs for both the Bk head and color heads.

Meanwhile, the printing apparatus according to the present embodiment having the printhead 5 can supply the printhead 5 with electric power of 20 W. More specifically, assuming that the total of four printheads including Bk head, Y head, M head and C head are mounted, driving voltage (Vh) of the printhead is 24 V, and driving pulsewidth (P) is 3 μs, the driving period (f) of the printhead can be minimized to 160 μs. As described above, since the refill time of each head is 100 μs, if the printhead 5 is driven in the driving period (f)=160 μs (6.25 KHz), it is possible to satisfy both conditions of ink refill time and power capacity.

Since the printing apparatus according to the present embodiment adopts a printhead of exchangeable and disposable type, the printhead 5 does not always include the Bk head, C head, M head and Y head for color printing as described above. Although color printing has recently become increasingly popular, there is still a large number of monochrome printing performed using only black ink since print jobs consisting of characters only, e.g. text, are often performed. Therefore, there is a case where only the Bk head is mounted on the carriage 6, not mounting the C head, M head and Y head.

The printing apparatus according to the present embodiment includes means for detecting the type and the number of printheads mounted.

Figure 3:
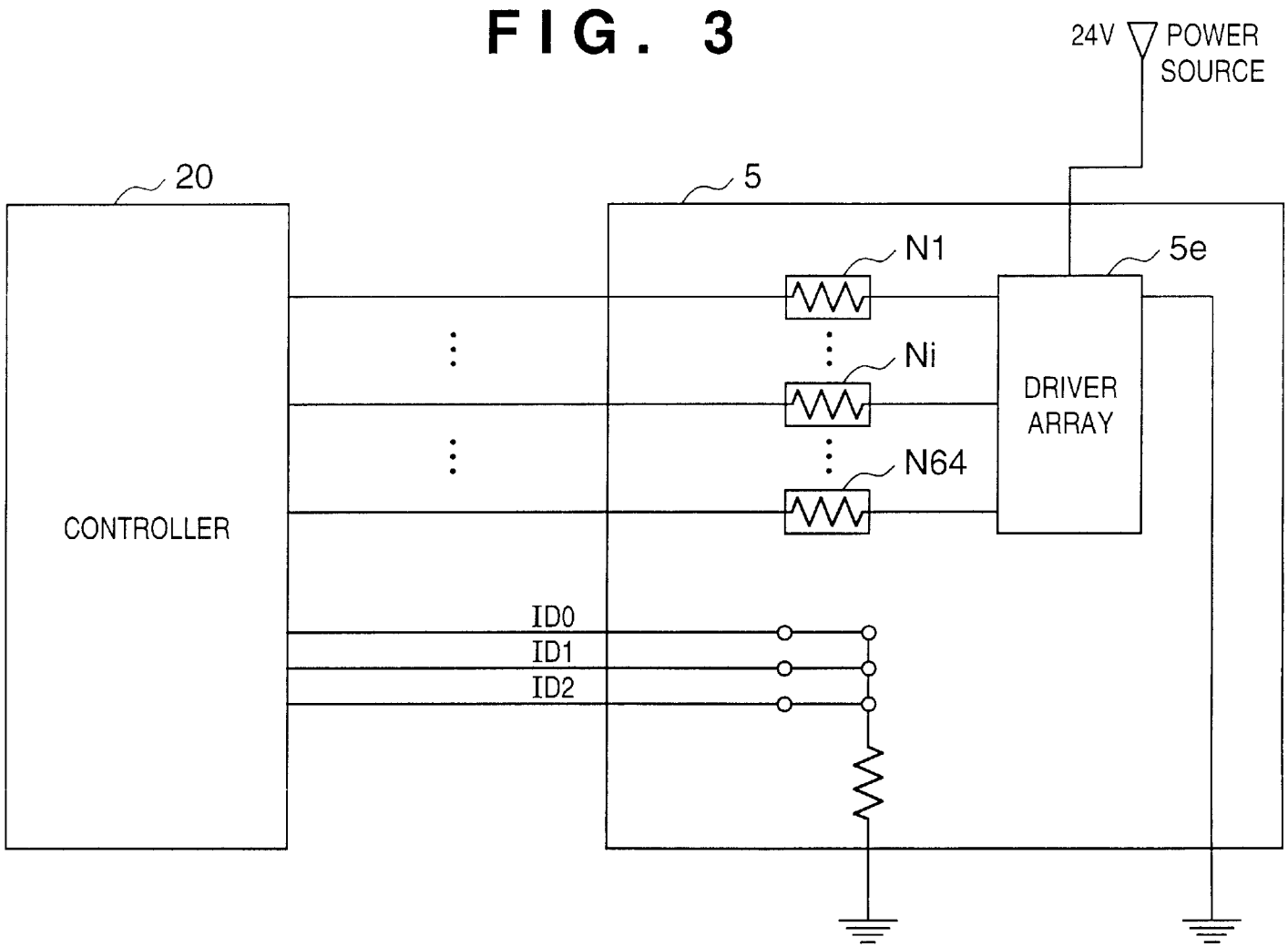
FIG. 3 is a block diagram showing connections of data lines between the controller 20 and printhead 5.

FIG. 3 is a block diagram showing connections of data lines between the controller 20 and printhead 5.

In the actual structure for control, the interface unit 21 and head driver 28 exist between the controller 20 and printhead 5. However, to simplify the description, these components are not shown. Moreover, since the four heads included in the printhead 5 have the same structure, FIG. 3 shows the structure of only one of the four heads.

Referring to FIG. 3, reference symbol N1 denotes a printing element corresponding to nozzle 1; Ni, a printing element corresponding to nozzle i; and N64, a printing element corresponding to nozzle 64. Reference symbol 5*e* denotes a driver array for applying power voltage from a power source to each of the printing elements and driving the printing elements. Driving signals for each printing element are sent by the controller 20 via the driver 28 and interface unit 21. As described above, the printhead is time-divisionally driven by dividing 64 printing elements into four blocks so as to drive in groups of 16 printing elements. The number of blocks to be divided and a block to be driven or the like are controlled by the controller 20. The existence of printhead and the type of printhead mounted are detected by whether or not signal lines ID0, ID1 and ID2 are connected (open/closed) between the printing apparatus and printhead.

FIG. 4 is a table showing open/closed relations between the type of printhead and signal lines ID0, ID1 and ID2.

As shown in FIG. 4, the type of head: Y head, M head, C head, or Bk head, is identified by two-bit data generated based on the open/closed state of the signal lines ID0 and ID1. For instance, if the signal lines ID0 and ID1 are both open, the mounted head is a Y head, and if the signal line ID0 is closed and the signal line ID1 is open, the mounted head is an M head. In this manner, the controller 20 obtains information through the interface unit 21 as to the open/closed state of the signal lines ID0 and ID1 and finds the combination of open/closed state of the signal lines ID0 and ID1, which determines the type of printhead. Note that the signal line ID2 is a terminal line which detects the existence of printhead. If a head is mounted, the signal line ID2 is closed. Thus, the open/closed state of the signal line ID2 determines whether or not the printhead is mounted on the carriage 5.

Such signal lines in the printhead side and the printing apparatus side are connected to each other in the carriage 6. More specifically, at the connection portion of the carriage 6 with the printhead 5, four groups of connection terminals are situated, each group consisting of connection terminals of signal lines ID0, ID1 and ID2. The existence of printhead and the type of printhead are determined for each of the groups. Moreover, based on the position where the four groups of connection terminals are situated, it is possible to determine which type of printhead is mounted and where the printhead is mounted.

Figure 5:
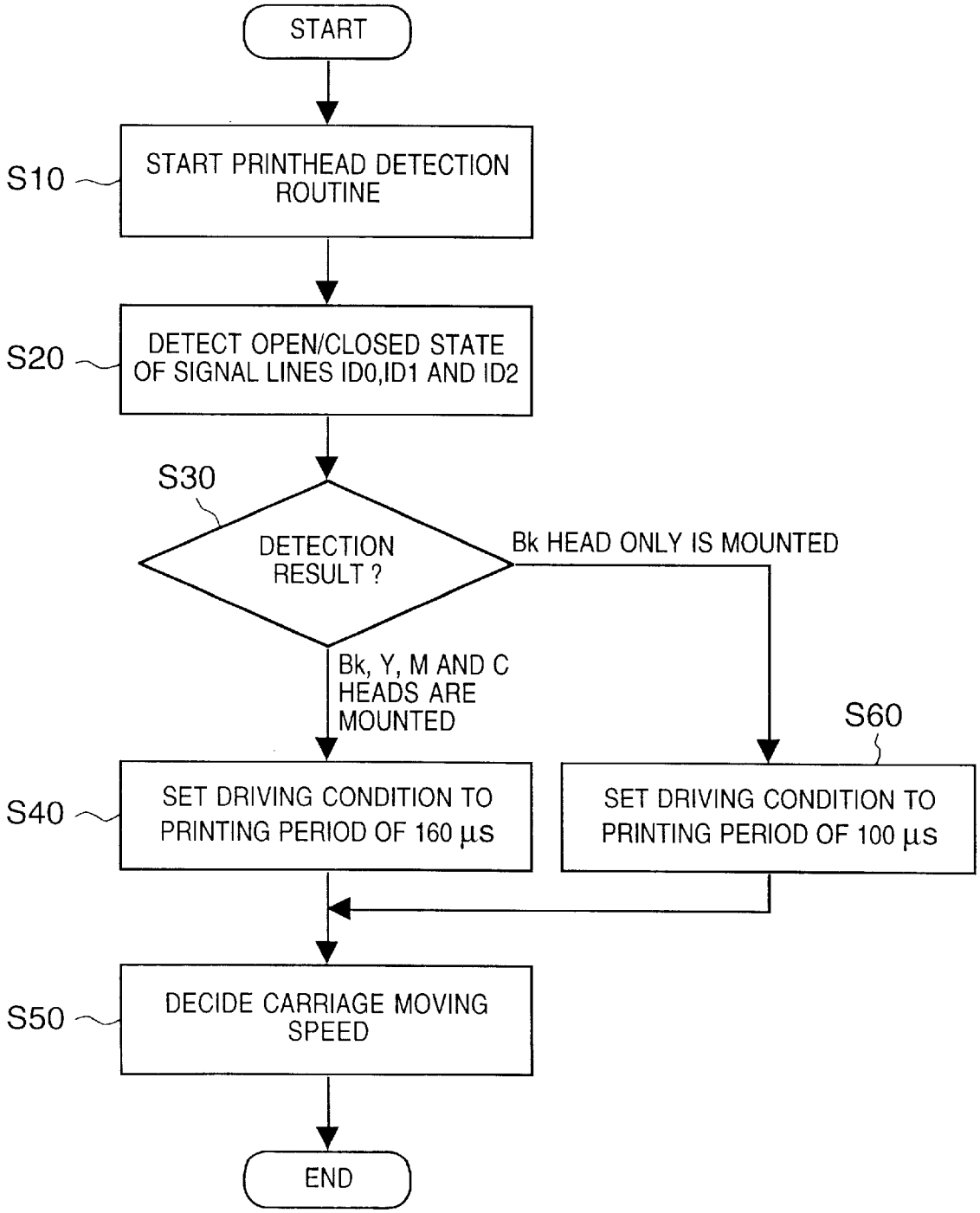
FIG. 5 is a flowchart showing print control performed in accordance with the result of detection of the type and the number of printheads mounted.

In accordance with the open/closed state of the three signal lines ID0, ID1 and ID2 described above, the type and the number (position) of the printhead mounted are detected. Bas ed on the detected result, printing control described in the flowchart in FIG. 5 is executed.

More specifically, in step S10, a printhead detection routine is started when the power of the printing apparatus is turned on. In step S20, based on the open/closed state of the three signal lines ID0, ID1 and ID2, the type of printhead, the position the printhead is mounted on the carriage 6, and the number of heads mounted are detected with respect to each head.

Next, in step S30, the detection result is examined. In a case it is determined that the four types of printheads, Y, M, C and Bk heads, are mounted on the carriage, the process proceeds to step S40 where a printhead driving condition is set such that the printhead is driven in a 160 μs period. In step S50, the moving speed of carriage 6 is decided based on the set driving condition and the process ends.

Meanwhile, in a case where it is determined that only the Bk head is mounted on the carriage, the process proceeds to step S60 where the driving period is reduced from 160 μs to the shortest driving period which requires less than the maximum supplied electric power (20 W) and satisfies the condition of refill time. In other words, the driving condition is set such that the printing frequency is increased. By virtue of this, printing speed is increased and printing time is reduced.

For instance, in a case of driving only one Bk head, if the printhead is driven in the driving period (f) of 100 μs, the required electric power is 10.1 W which is well below the maximum consumable power 20 W. Moreover, even if the time required for ink refill is taken into consideration, since the Bk head is capable of being driven in printing period of 100 μs, increased driving speed is sufficiently achieved. Comparing this speed with the case of printing period of 160 μs adopted at the time of color printing, 1.6 times faster speed can be achieved.

Then, the process proceeds to step S50 where the moving speed of carriage 6 is decided based on the set driving condition and the process ends.

According to the above-described embodiment, since the type and the number of printheads mounted on the carriage are detected, and the printing period is dynamically changed based on the detected result so as to achieve the shortest printing period which requires less than the maximum electric power supplied by the printing apparatus and satisfies the condition of ink refill time, and moreover since the carriage moving speed is decided in accordance with the changed printing period, it is possible to perform printing at high speed by sufficiently using each printhead to its full capability.

Note that in the above-described embodiment, although determination is made as to whether or not a color head is mounted and the printing period of Bk head is reduced based on the determination result, the present invention is not limited to this. For instance, even if a color head is not mounted, determination may be made as to the type of image data transferred by an external apparatus, e.g., a host unit, to the printing apparatus, and the printing period of Bk head may be reduced if the type of image data is monochrome image data.

Furthermore, such change in the printing period of a printhead may be made for each sheet of print medium, or for each scan of the printhead.

Further, although the above described embodiment assumes that the refill time is the same for all types of printheads, in a case where the refill time differs for each printhead (ink), the printing speed may be set according to the slowest refill time of ink used in printing.

Moreover, in accordance with the type and the number of the printheads mounted, the number of blocks of printing elements divided for time-divisional driving of the printhead may be changed.

Hereinafter, description will be provided on the operation of changing the number of blocks for the time-divisional driving operation in which the entire printing elements of the printhead are divided into a plurality of blocks to be driven divisionally.

Assume herein that the number of printing elements of the printhead is 64 as mentioned above. The description will be given on the example of 8-block driving where 64 printing elements are divided into 8 blocks each consisting of 8 printing elements and driven respectively, and the example of 16-block driving where 64 printing elements are divided into 16 blocks each consisting of 4 printing elements and driven respectively.

When an ink-jet head, such as the printheads 5*a* to 5*d*, discharges ink by driving printing elements, a pressure wave is generated in the direction opposite to the ink-discharge direction. Therefore, by repeatedly discharging ink, fluid vibration is generated, and this may negatively influence ink discharge of other nozzles in the printhead. It is known that the influence of fluid vibration is greater as the number of printing elements driven simultaneously increases. Thus, comparing the aforementioned 8-block driving with the 16-block driving, 16-block driving where the printing elements are divided into a larger number of blocks, can perform more stable discharge operation by effectively suppressing the fluid vibration. However, the time necessary to drive each of the blocks is almost the same in both cases of the 8-block driving and 16-block driving; as a result, printing speed in 16-block driving operation is lower than that in 8-block driving.

In view of the above, the present invention presumes a user's usage of the printing apparatus based on the type and the number of printheads mounted to the printing apparatus, and changes the number of block division for time-divisional driving operation, thereby achieving stable discharge operation and high printing speed.

For instance, in a case where a printhead for discharging color ink and a printhead for discharging black ink are mounted on the printing apparatus, it is presumed that a user will print a photographic image or a color image (particularly a color image including monotone portions) or the like. In such case, high quality color printing is desired. Thus, it is preferable to adopt a driving control which can achieve a stable discharge operation rather than to adopt a driving control imposing a heavy load on the printhead. More specifically, by adopting the 16-block driving, i.e., adopting the number of block division 16, the number of nozzles driven simultaneously is decreased and the fluid vibration is suppressed, thereby achieving a stable discharge operation.

In a case where only the printhead for discharging black ink is mounted, it is presumed that a user will be more likely to print a text-based document rather than a photographic image using black only. Such image, including characters and text, often has very few monotone image portions. Therefore, it can be presumed that it is less likely to continuously drive the printing elements or simultaneously drive a large number of printing elements. Thus, in this case, even if the printing apparatus is set to perform the driving control where a relatively heavy load is imposed on the printhead, an image having satisfactory quality can be outputted in many cases. Accordingly, in a case where only a printhead which discharges black ink is mounted, the printing apparatus is controlled to perform the aforementioned 8-block driving, in order to maintain satisfactory quality in printing characters and text images and achieve printing at high speed.

Furthermore, when the number of blocks for time-divisional driving is changed as described above, if the driving period of each block satisfies the driving period enabling the stable printing operation, the scan speed of the printhead does not need to be changed. Moreover, in a case where the number of blocks in time-divisional driving is changed without changing the driving period of each block, the scan speed of the printhead is changed such that the printing position is not affected by the changed number of blocks in time-divisional driving.

As has been described above, based on the user's usage of the printing apparatus which can be presumed from the type and the number of printheads mounted on the printing apparatus, various conditions for print control are optimized so as to achieve, for instance, stable discharge operation in a case where the user desires high-quality color image printing, or achieve high-speed printing in a case where characters or text images are printed and printing elements are seldom continuously driven. Accordingly, the printing apparatus can be utilized to its full capability, and an image suitable to the user's usage can be printed in high quality at high speed.

If a reduced driving period due to the above-described change causes a situation where the driving period becomes smaller than the time necessary for driving each block, the number of blocks for time-divisional driving can be changed as described above. Meanwhile, in a case where the driving period cannot be reduced further than a predetermined period, the number of blocks for the time-divisional driving can be decreased. By this, printing at higher speed can be attained.

Note that the printing apparatus may further include a construction for changing the number of blocks for time-divisional driving, or for changing the driving pulse in accordance with the type and the number of printheads mounted to the printing apparatus.

Moreover, detecting the type of printhead mounted as described above can be adopted to optimize execution of recovery processing of the printhead.

As described above, recovery processing, e.g. suction recovery, preliminary discharge, wiping the ink discharge surface of the printhead or the like, is executed as necessary in order to maintain the reliability of ink discharge in ink-jet printing. However, it is preferable that such recovery processing be executed as small a number of times as possible as long as the reliability of ink discharge is maintained, taking into account of ink consumption and reduced printing time (throughput). However, according to the conventional technique, the timing at which recovery processing is executed is fixed in accordance with a printhead requiring the preliminary discharge, wiping and suction recovery in the shortest timing among the Y head, M head, C head and Bk head.

In view of this, the type of printhead mounted is detected, and execution of recovery processing, i.e., the time intervals of preliminary discharge, wiping and suction recovery, is optimized based on the detected result. By this, unnecessary recovery processing is prevented, thus minimizing wasteful ink consumption and reduced throughput.

[Other Embodiments]

In the first embodiment, the description has been given on an example of changing the printing period of the Bk head in a case where only one Bk head is mounted on the carriage. Hereinafter, description will be provided on the print control in a case where it is detected that a plurality of Bk heads are mounted on the carriage. Herein, an example is provided in a case where two Bk heads are mounted and printing is performed by using the two Bk heads simultaneously, and the example will be described with reference to FIGS. 6A–6C and FIG. 7. It is assumed that the printing apparatus and printhead having the similar specifications as described in the foregoing embodiment are used in the present embodiment.

Figures 6A, 6B, 6C:
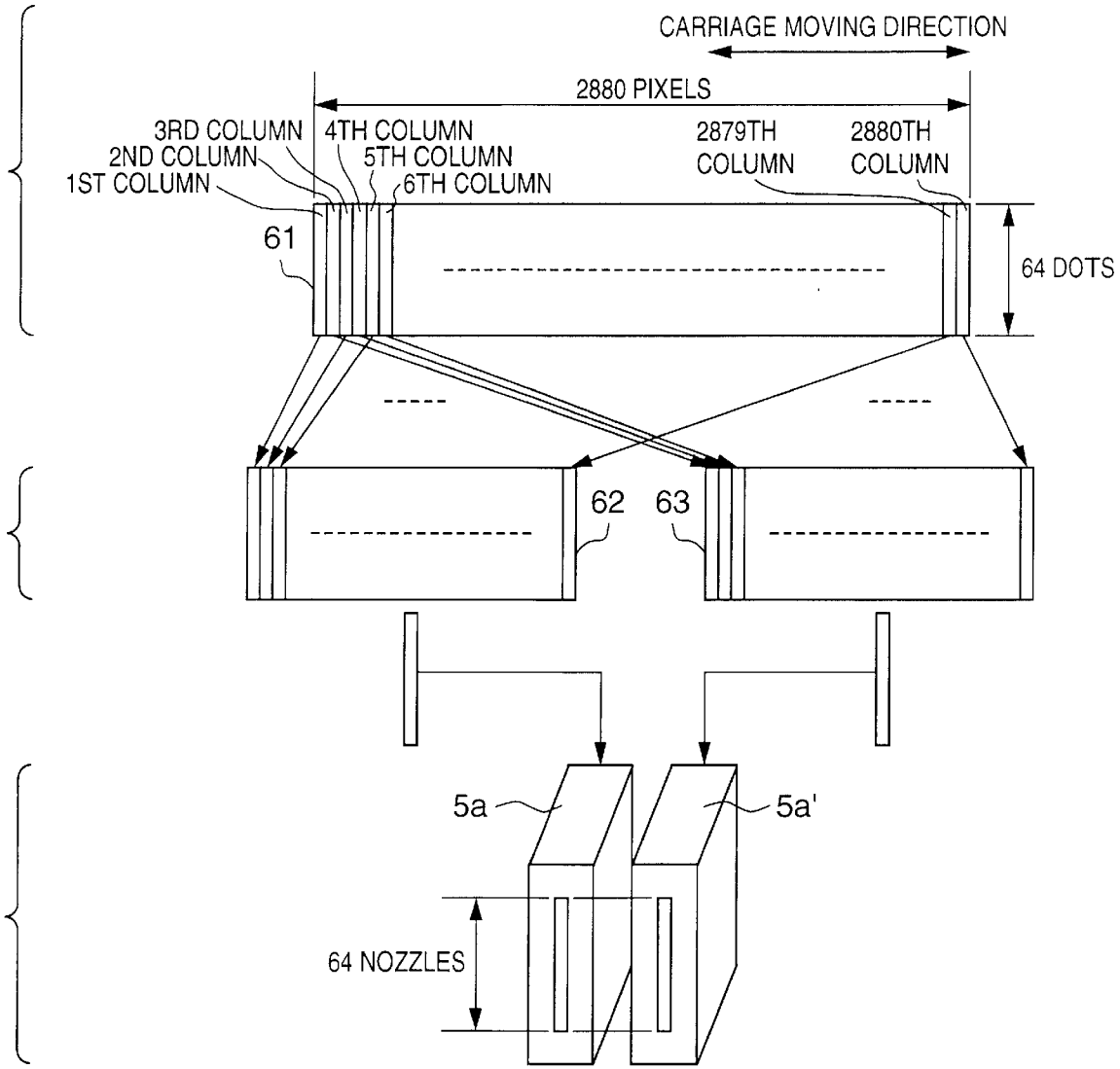
FIGS. 6A, 6B and 6C are explanatory views showing image data corresponding to a single scan, subjected to printing by two heads and how the image data is divided and allocated to the two Bk heads.

FIGS. 6A–6C show image data corresponding to a single scan, subjected to printing by two Bk heads, and how the image data is divided and allocated to the two Bk heads.

Figure 7:
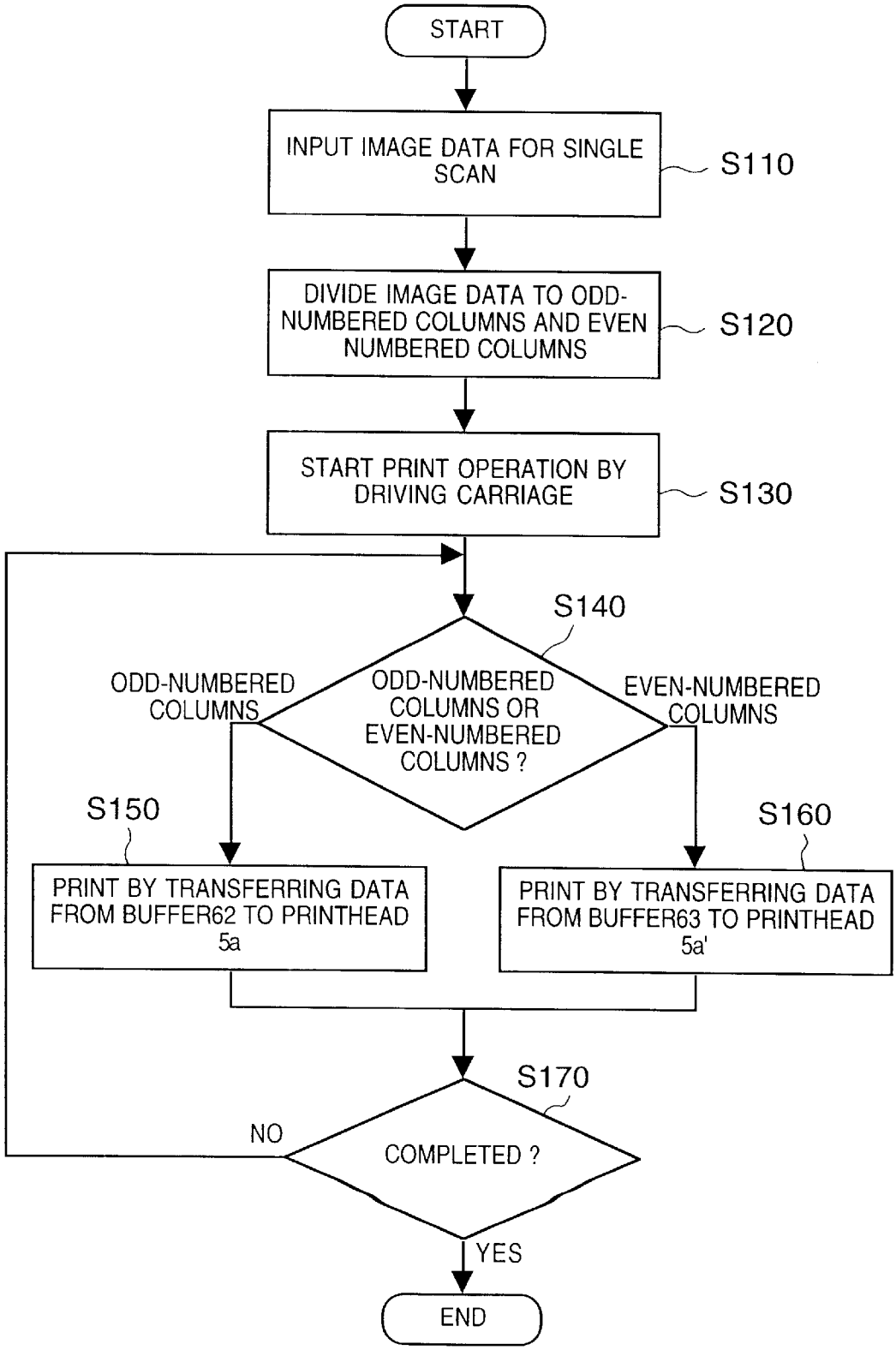
FIG. 7 is a flowchart showing the steps of print control performed when the image data shown in FIGS. 6A to 6C is printed by two Bk heads.

FIG. 7 is a flowchart showing the steps of print control performed when the image data shown in FIGS. 6A to 6C is printed by the two Bk heads.

First, in step S110, image data corresponding to a single scan, subjected to printing by the two Bk heads, is inputted by an external apparatus such as a host. It is assumed in the present embodiment that printing is performed at 360 dpi for a width of 8 inches (2880 pixels) in the carriage moving direction. Therefore, image data having the construction shown in FIG. 6A is stored in a buffer 61 provided in the RAM 20*c*.

Next, in step S120, image data stored in the buffer 61 is divided into two blocks of image data. More specifically, as shown in FIG. 6B, with respect to the image data stored in the buffer 61, image data in the 1st, 3rd, 5th . . . , 2879th columns (odd-numbered columns) are stored in a buffer 62, and image data in the 2nd, 4th, 6th . . . , 2880th columns (even-numbered columns) are stored in a buffer 63. Note that the division may be made by logically dividing the original print buffer 61, or two buffers 62 and 63 may be defined in other areas of the RAM 20*c*.

Upon completing the division processing, print operation is started by moving the carriage 6 in step S130. In step S140, as the carriage 6 moves, which column of image data is to be used in printing is determined. Herein, when printing is performed by using image data in the odd-numbered columns, the process proceeds to step S150 where image data is transferred from the buffer 62 to the Bk head 5*a* for printing as shown in FIGS. 6B and 6C. Then, the process proceeds to step S170.

Meanwhile, when printing is performed by using image data in the even-numbered columns, the process proceeds to step S160 where image data is transferred from the buffer 63 to the other Bk head 5*a*' for printing as shown in FIGS. 6B and 6C. Then, the process proceeds to step S170.

In the printing processing in steps S150 and S160, the two printheads respectively perform printing for the odd-numbered columns and the even-numbered columns. Thus, the print timing period is twice longer than a case where the same image data is printed by using one printhead. Therefore, even if the carriage speed is set twice as fast (i.e., the print speed is twice as fast) to perform printing, the printing period of each printhead is substantially the same as the case where one printhead is used for printing (according to the foregoing embodiment, the printing period is 100 $\mu$s). In view of the above, when the carriage 6 is driven in step S130, the carriage speed in the present embodiment is set twice as fast as that of the first embodiment. By virtue of this, printing is performed as if one printhead is driven in the printing period of 50 $\mu$s.

Note that although the Bk head consumes a larger amount of electric power per nozzle than a color head, since the image printed is a monochrome image, even if the carriage is driven twice as fast, the electric power consumed is about 20 W at the maximum, which can be limited to under the rated power of 20 W. Therefore, problems will not occur in practical sense.

In step S170, determination is made as to whether or not the printing for a single scan is completed as the carriage 6 moves. If it is determined that printing is not completed, the process returns to step S140 to continue print operation, while if it is determined that printing is completed, the carriage 6 is brought back to the home position to end the printing for the single scan.

As has been described above, according to the present embodiment, in a case where a plurality of Bk heads which discharge black ink are mounted on the carriage, image data is divided and the divided image data is allocated to each of the printheads for printing. By virtue of this, the print period of each printhead is prolonged. Even if the carriage speed is increased, the printing period of each printhead is not reduced; thus, carriage speed can be raised to achieve increased printing speed.

Note that although the present embodiment has described a case of using a plurality of Bk heads, the present invention is not limited to this. For instance, the embodiment can be similarly applied to a case of using a plurality of color heads discharging the same color of ink. More specifically, if the total amount of electric power supplied to the printhead is less than the maximum capacity (20 W in the present embodiment) and the driving period is more than the refill time of each nozzle (100 $\mu$s in the present embodiment), print data is divided and the driving period of printhead is decided in accordance with the number of printheads mounted so as to achieve the shortest driving period.

Furthermore, although the above-described embodiment detects the type of printhead based on the pattern of data-line connection between the controller 20 and printhead 5, the present invention is not limited to this. For instance, the type of printhead can be detected by the following method.

Figure 8:
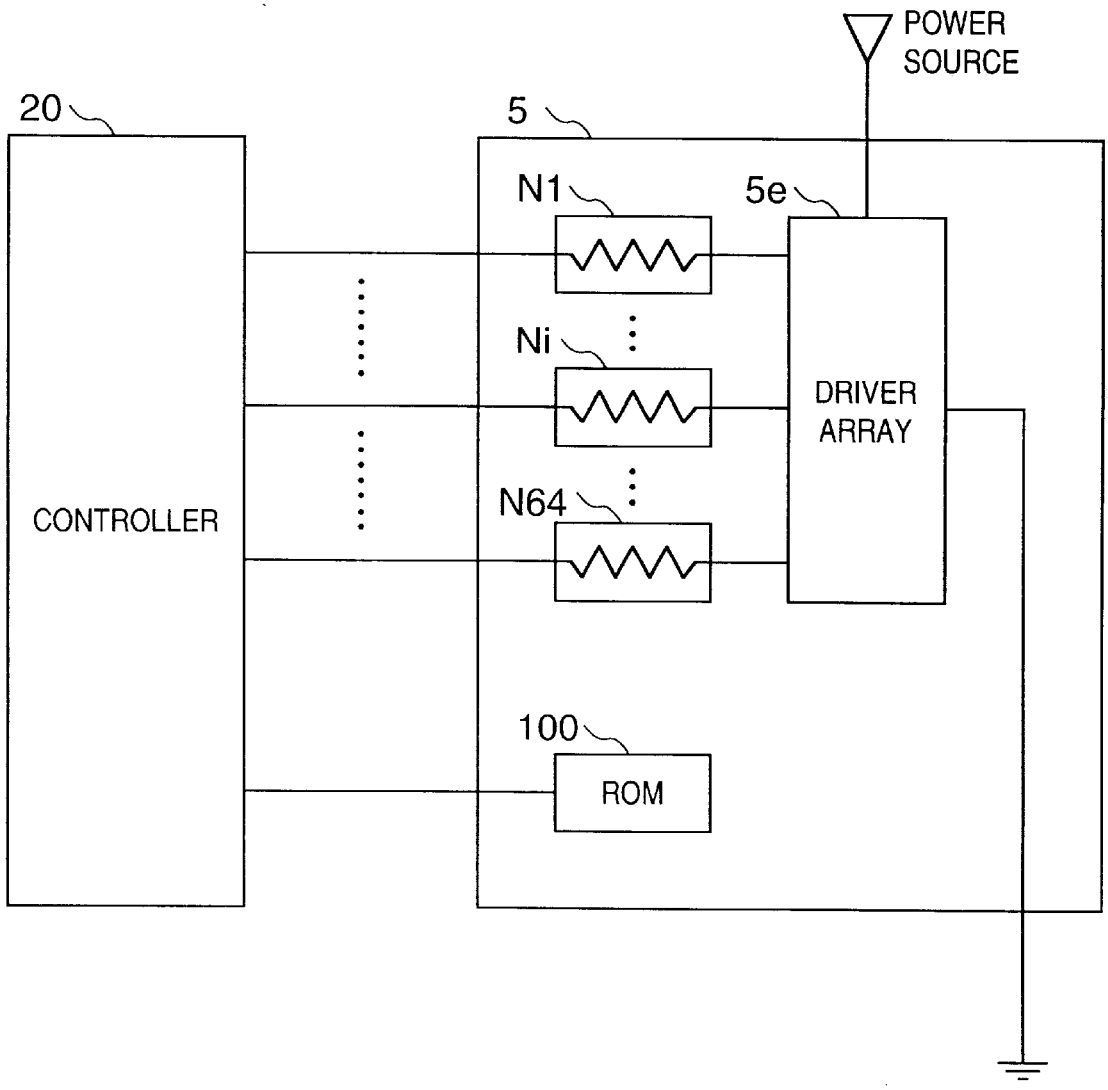
FIG. 8 is a block diagram showing another pattern of connections of data lines between the controller 20 and printhead 5.
Figure 9:
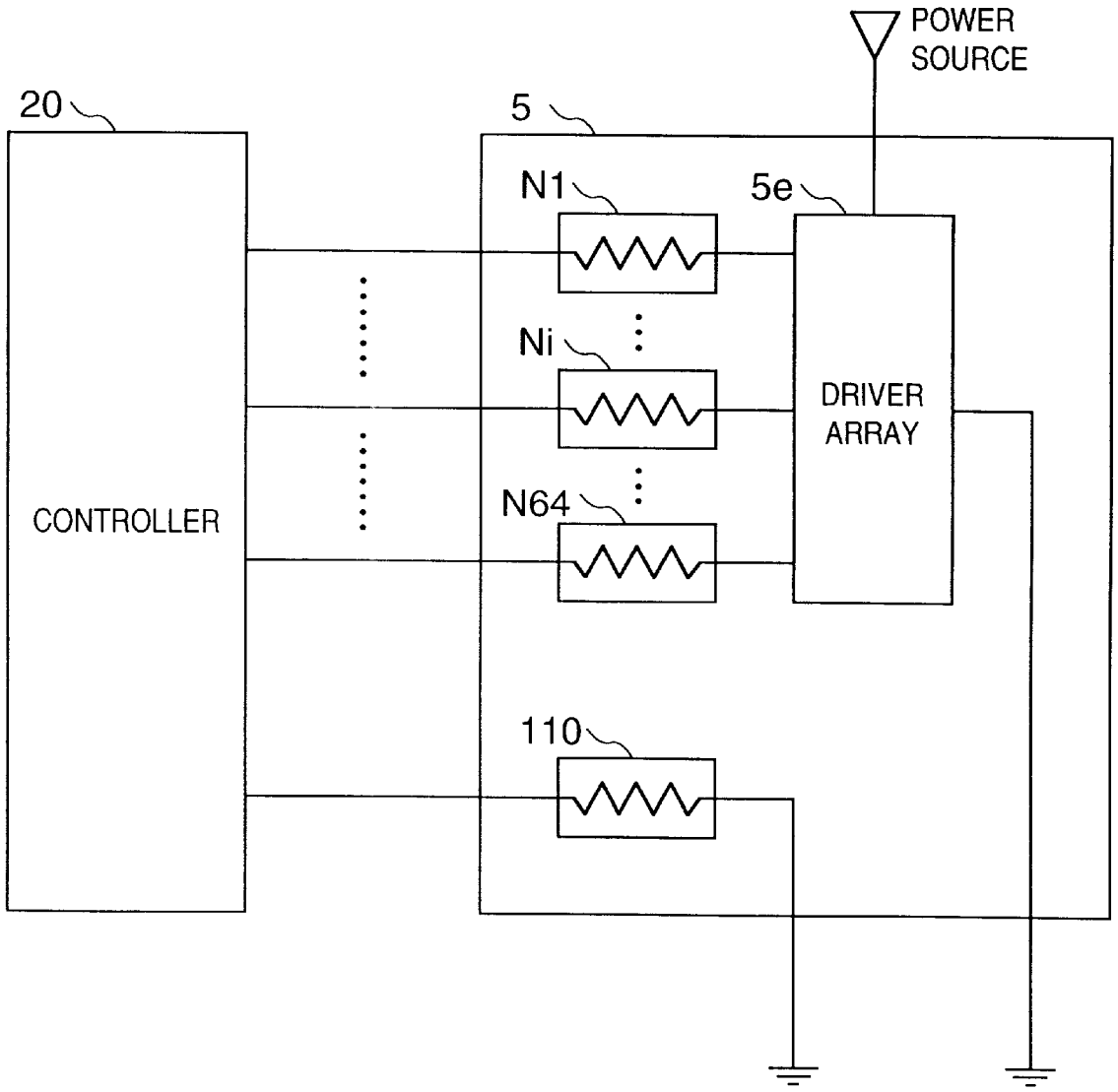
FIG. 9 is a block diagram showing still another pattern of connections of data lines between the controller 20 and printhead 5.

To show the examples, FIGS. 8 and 9 are block diagrams showing other patterns of connections of data lines between the controller 20 and printhead 5. Note that in FIGS. 8 and 9, components having the same structure as those in FIG. 3 are assigned with the same reference numerals, and description thereof will not be provided herein. Similar to FIG. 3, since the four heads included in the printhead 5 have the same structure, only one of the heads is shown.

According to the construction in FIG. 8, ID data indicative of the type of printhead is stored in a predetermined address of the ROM 100. The controller 20 selects the ROM 100 by using a CS (chip select: not shown), designates the address where the ID data indicative of the type of printhead is stored through an address bus (not shown), and reads the ID data of the printhead through a data bus (not shown).

By performing the above process with respect to all the printheads mounted on the printing apparatus, the types of all printheads are detected.

Note that the ROM 100 may be incorporated in the apparatus by later incorporating an IC chip in the control circuit substrate of the printhead. Alternatively, as similar to the head driver 28 integrated in the heater board of the printhead, a heater board having memory functions may be incorporated in the apparatus.

Next, according to the construction shown in FIG. 9, the printhead 5 includes, in addition to the printing elements N1 to N64, a resistor 110 having a particular resistance value in accordance with the type of printhead. The controller 20 reads a partial voltage of the resistor 110 and determines the type of printhead based on the read value.

By performing the above process with respect to all the printheads mounted on the printing apparatus, the types of all printheads are detected.

Note that in the foregoing embodiments, although the descriptions have been provided based on the assumption that a droplet discharged by the printhead is ink and that the liquid contained in the ink tank is ink, the contents are not limited to ink. For instance, the ink tank may contain processed liquid or the like which is discharged to a print medium in order to improve the fixation or water resistance of the printed image or to improve the image quality.

The embodiments described above comprise means (e.g., an electrothermal transducer, laser beam generator and the like) for generating heat energy as energy utilized upon execution of ink discharge, and causing a change in state of ink by the heat energy, among the ink-jet printing methods. According to this ink-jet printing method, a high-density, high-precision printing operation can be attained.

As the typical arrangement of the ink-jet printing system, one practiced by use of the basic principle disclosed in, for example, U.S. Pat. Nos. 4,723,129 and 4,740,796 is preferable. The above system is applicable to either one of so-called on-demand type and continuous type systems. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse-form driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Laid-Open No. 59-123670, which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the maximum width of a printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a main color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium, or the like, is applicable to the present invention. In this case, ink may be situated opposite to electrothermal transducers while being held in a liquid or solid state in recess portions of a porous sheet or through-holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Furthermore, it goes without saying that the invention is applicable also to a case where the object of the invention is attained by supplying a memory medium which stores program codes of software realizing the functions of the above-described embodiments to a system or apparatus, reading out the program codes from the memory, and executing them in a computer (or a CPU or MPU) of the system or apparatus.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides the aforesaid functions according to the above embodiments being realized by executing the program codes which are read by a computer, the present invention includes a case where an OS (operating system) or the like working in the computer performs a part of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or an entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing on a print medium with at least one mounted printhead having a plurality of print elements, comprising:

a mounting portion in which the at least one printhead can be mounted;

scanning means for reciprocally scanning the at least one printhead;

detecting means for detecting a type and a number of printheads mounted;

first determining means for determining a driving condition of the at least one printhead based on a result of detection by said detecting means;

second determining means for determining a scanning speed of said scanning means based on the driving condition determined by said first determining means;

a power supply, having a predetermined power capacity, for supplying electric power to drive the at least one printhead mounted in said mounting portion; and control means for controlling a print operation by driving the at least one printhead based on the driving condition determined by said first determining means, and by driving said scanning means based on the scanning speed determined by said second determining means, wherein the driving condition of the at least one printhead is determined based on the result of detection by said detecting means and the predetermined power capacity of said power supply.

2. The apparatus according to claim 1, wherein the at least one printhead is an ink-jet printhead which performs printing by discharging ink.

3. The apparatus according to claim 2, wherein the at least one printhead comprises an electrothermal transducer for generating heat energy in order to discharge ink by utilizing the heat energy.

4. The apparatus according to claim 2, further comprising:

recovery means for performing a recovery operation on the at least one printhead; and recovery control means for setting a recovery condition of said recovery means based on the result of detection by said detecting means and controlling said recovery means in accordance with the set recovery condition.

5. The apparatus according to claim 4, wherein the recovery condition includes at least one of a time interval for performing preliminary discharge, a wiping interval for wiping an ink discharge surface of the at least one printhead, and a time interval for performing suction recovery.

6. The apparatus according to claim 2, wherein the at least one printhead includes:

a first printhead for discharging black ink;

a second printhead for discharging yellow ink;

a third printhead for discharging magenta ink; and a fourth printhead for discharging cyan ink.

7. The apparatus according to claim 6, wherein said detecting means detects whether only the first printhead is mounted, or the first, second, third and fourth printheads are mounted, and the driving condition determined by said first determining means is a printing period for discharging ink from the at least one printhead according to the result of detection.

8. The apparatus according to claim 6, wherein said detecting means detects whether or not a plurality of the first, second, third or fourth printheads are mounted, and said second deciding means decides the scanning speed of the scanning means according to the result of detection.

9. The apparatus according to claim 6, wherein said scanning means comprises a carriage on which the four printheads are mounted, wherein said carriage comprises four groups of first connection terminals for connection to the at least one printhead for identifying the type of printhead mounted, each of the at least one printhead comprises a second connection terminal to be connected to one of the first connection terminals, and said detecting means detects the type and number of printheads based on a connection state between the first and second connection terminals.

10. The apparatus according to claim 9, wherein the first and second connection terminals respectively comprise three connection terminals, and said detecting means detects existence of a mounted printhead based on a connection state of one of the three connection terminals and detects the type of printhead based on a connection state of the remaining two connection terminals.

11. The apparatus according to claim 6, wherein said scanning means comprises a carriage on which the four printheads are mounted, wherein said carriage comprises four first connection terminals for connection to the printheads for identifying the type of printhead mounted, each printhead comprises a second connection terminal to be connected to one of the first connection terminals and a ROM storing information indicating the type of the printhead, and said detecting means detects the type and number of printheads based on the information from the ROM inputted by a connection between the first and second connection terminals.

12. The apparatus according to claim 6, wherein said scanning means comprises a carriage on which the four printheads are mounted, wherein said carriage comprises four first connection terminals for connection to the printheads for identifying the type of printhead mounted, each printhead comprises a second connection terminal to be connected to one of the first connection terminals and a resistor, whose value indicates the type of the printhead, connected to the second connection terminal in series, and said detecting means detects the type and number of printheads based on a voltage drop caused by the resistor by a connection between the first and second connection terminals.

13. The apparatus according to claim 1, further comprising divisional drive means for dividing the plurality of print elements in the printhead into a plurality of blocks, and sequentially driving each of the plurality of blocks, wherein the driving condition determined by said first determining means is a number of the plurality of blocks.

14. A print control method using at least one printhead for performing printing on a print medium by reciprocally scanning the at least one printhead, comprising:

a detecting step of detecting a type and a number of printheads mounted;

a first determining step of determining a driving condition of the at least one printhead based on a result of detection in said detecting step;

a second determining step of determining a scanning speed of the at least one printhead based on the driving condition determined in said first determining step;

a power supplying step of supplying electric power from a power supply having a predetermined power capacity to drive the at least one mounted printhead; and a control step of controlling a print operation by driving the at least one printhead based on the driving condition and scanning speed determined in said first and second determining steps, wherein the driving condition of the at least one printhead is determined based on the result of detection in said detecting step and the predetermined power capacity of the power supply.

15. The method according to claim 14, wherein, in a case where the at least one printhead is an ink-jet printhead which performs printing by discharging ink, said method further comprising:

a recovery step of performing a recovery operation on the at least one printhead; and a recovery control step of setting a recovery condition for said recovery step based on the result of detection in said detecting step and executing said recovery step in accordance with the set recovery condition.

16. A printing apparatus for performing printing on a print medium by mounting and controlling at least one printhead having a plurality of print elements, comprising:

a mounting portion in which a plurality of the printheads can be mounted;

detecting means for detecting a type and a number of printheads mounted in said mounting portion;

divisional drive means for dividing the plurality of print elements in a printhead into a plurality of blocks, and sequentially driving each of the plurality of blocks; and control means for changing a number of the plurality of blocks based on a result of detection by said detecting means, and effecting printing.

17. The apparatus according to claim 16, wherein the at least one printhead is an ink-jet printhead which performs printing by discharging ink.

18. The apparatus according to claim 17, wherein the at least one printhead comprises electrothermal transducers for generating heat energy in order to discharge ink by utilizing the heat energy.

19. A print control method for performing printing on a print medium by mounting and controlling at least one printhead having a plurality of print elements, comprising:

a detecting step of detecting a type and a number of printheads mounted in a mounting portion in which a plurality of printheads can be mounted;

a determining step of determining a division number by which the plurality of print elements are divided, based on a result of detection in said detecting step; and a driving step of dividing the plurality of print elements into a plurality of blocks by the division number determined in said determining step, and sequentially driving each of the plurality of blocks.

* * * * *